United States Patent [19]

Figueroa et al.

[11] 4,014,044

[45] Mar. 29, 1977

[54] PROTECTIVE DEVICE

[76] Inventors: David C. Figueroa, 194 15 E. Adams, Reedley, Calif. 93654; David R. Corneliuz, 3856 E. Farrin, Fresno, Calif. 93726

[22] Filed: Jan. 14, 1976

[21] Appl. No.: 648,974

[52] U.S. Cl. ..... 2/2; 2/404; 128/98; 128/138 R; 128/159; 128/168

[51] Int. Cl.[2] ..... A41D 13/00; A41C 1/00

[58] Field of Search ..... 2/2, 404, 403; 128/159, 128/160, 157, 98, 138 R, 168, 288

[56] References Cited

UNITED STATES PATENTS

| | | | |
|---|---|---|---|
| 1,588,066 | 6/1926 | Thorp | 128/160 |
| 2,802,465 | 8/1957 | Brown | 128/159 |
| 3,339,208 | 9/1967 | Marbach | 128/132 R |
| 3,909,847 | 10/1975 | Holt et al. | 128/159 X |

*Primary Examiner*—H. Hampton Hunter
*Attorney, Agent, or Firm*—Huebner & Worrel

[57] ABSTRACT

A protective device particularly suited for use by male athletes characterized by a guard for protecting the pelvic organs including a protective cup configured to be positioned in protective relation with the groin of the wearer, a plate adapted to be received over the lumbar region of the wearer, and a protective bar extended between the cup and the plate suitably dimensioned to be received between the thighs of the wearer in protective relation with the pelvic organs, and a pair of trunks fabricated from elastomeric material and characterized by pockets formed in the front and rear portions thereof for maintaining the guard in place.

5 Claims, 5 Drawing Figures

PROTECTIVE DEVICE

BACKGROUND OF THE INVENTION

1. Field of the Invention

The invention generally relates to protective devices for the groins of male athletes, and more particulary to a protective device for protecting pelvic organs within the lower pelvic region or groin from ascending blows.

2. Description of the Prior Art

The prior art, of course, includes various types of protective devices for the groin of male athletes. Among such devices are those commonly referred to as a "cup" protector, which when worn by an athlete is positioned immediately in front of the pelvic organs in a protective, shielding relationship therewith. Such devices are particularly useful in protecting the wearer from impacting blows laterally delivered. Unfortunately, such devices do not protect the pelvic organs satisfactorily, particularly when impacting blows are delivered to the groin, upwardly between the thighs.

Due to the large numbers of athletes now engaged in martial arts, increasing numbers of injuries, particularly to the pelvic regions of athletes, are being experienced. The increased numbers of injuries result, at least in part, from the fact that combatants are employed in delivering impacting blows to the groin of opponents. Consequently, the blows delivered by the conbatants often are ascending blows which strike the opponent beneath the areas normally protected by the cups currently worn by the practitioners of these arts.

Moreover, when practicing the martial arts, the legs of the combatants often are elevated for thus exposing the groin to the opponent so that these regions are exposed and become particularly vulnerable to attack. Finally, the protective cups currently employed simply do not remain in position during combat with the attendant unfortunate consequence that the combatants are injured by blows laterally delivered.

In view of the foregoing, it should readily be apparent that there currently exists a need for an improved protective device which can readily and easily be employed for protecting the pelvic organs of athletes from ascending as well as laterally or horizontally delivered blows, directed at the groin, without impairing the athlete's maneuverability or agility.

It is, therefore, the general purpose of the instant invention to provide a protective device particularly suited for use by male athletes in protecting pelvic organs from impact when engaged in contact sports, such as the martial arts, without impairing the maneuverability or agility of the athletes.

OBJECTS AND SUMMARY OF THE INVENTION

It is, therefore, an object of the instant invention to provide an improved protective device which overcomes the aforementioned difficulties and disadvantages when worn by a male of the human species.

It is another object of the instant invention to provide an improved protective device for use by male athletes in protecting pelvic organs.

It is another object to provide an improved protective device particularly suited for use by male athletes in protecting pelvic organs from ascending as well as laterally delivered impacting blows.

It is another object to provide a protective device for the pelvic region of male athletes which includes a protective bar adapted to be extended between the thighs of the wearer in protective relation with the pelvic organs whereby the organs are shielded from both ascending and laterally delivered blows.

It is another object to provide a protective device particularly suited for use by male athletes which includes a guard comprising a cup for protecting the pelvic region, a bar adapted to be extended between the thighs for protecting the pelvic organs of a wearer and a pair of trunks for supporting the guard.

It is another object to provide a protective device for pelvic organs particularly suited for use by male athletes engaged in martial arts, although not necessarily limited in use thereto, since the device can be employed quite satisfactorily by athletes when engaged in other sports such as soccer, basketball, football and the like.

These and other objects and advantages are achieved through the use of a guard including a protective cup adapted to be positioned in a protective relationship with the pelvic region of a wearer, a plate adapted to be received over the lumbar region of the wearer, and a protective bar extending between the cup and the plate suitably dimensioned to be received between the thighs of the wearer in protective relation with the pelvic organs, and a non-binding garment formed of elastomeric material for supporting the guard, as will become more readily apparent by reference to the following description and claims in light of the accompanying drawings.

DESCRIPTION OF THE PREFERRED EMBODIMENT

Figure 1:
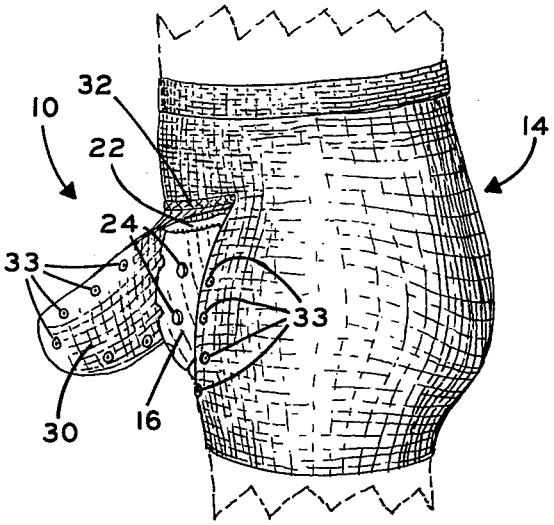
FIG. 1 is a side elevational view of a protective device, including a guard supported by a garment, which embodies the principles of the instant invention.
Figure 2:
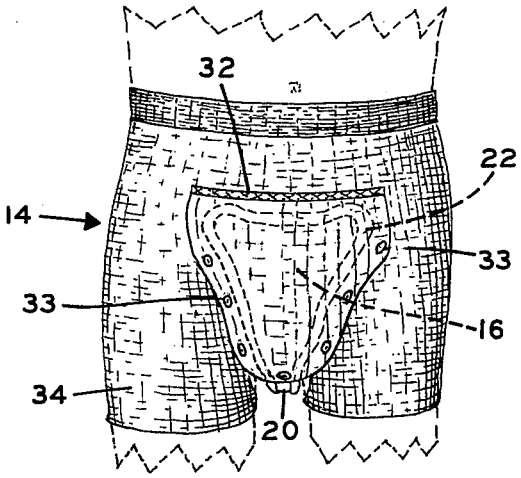
FIG. 2 is a front elevational view of the protective device.
Figure 3:
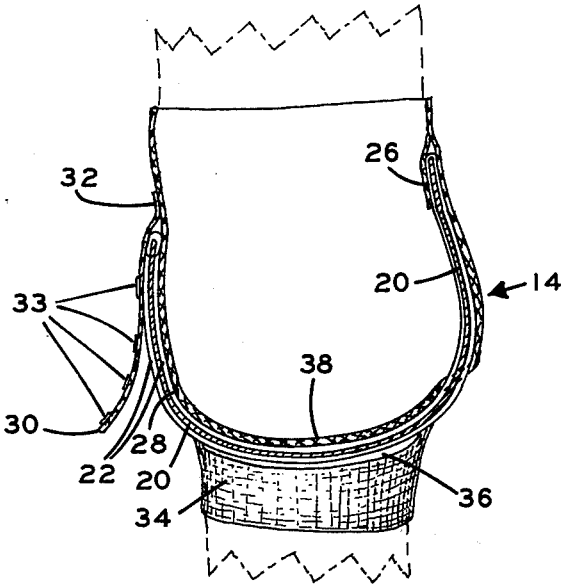
FIG. 3 is a cross-sectional view of the protective device, shown in FIGS. 1 and 2, taken generally along a vertical plane of symmetry.
Figure 4:
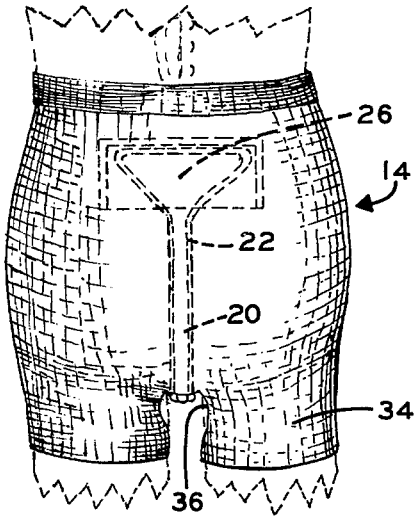
FIG. 4 is a rear elevational view of the device.

Referring now to the drawings with more particularity, wherein like reference numbers designate like or corresponding parts throughout the several views, there is shown in FIG. 1 a protective device, generally designated 10, which embodies the principles of the instant invention. The device 10 includes a guard, generally designated 12, and a supporting garment, generally designated 14.

Figure 5:
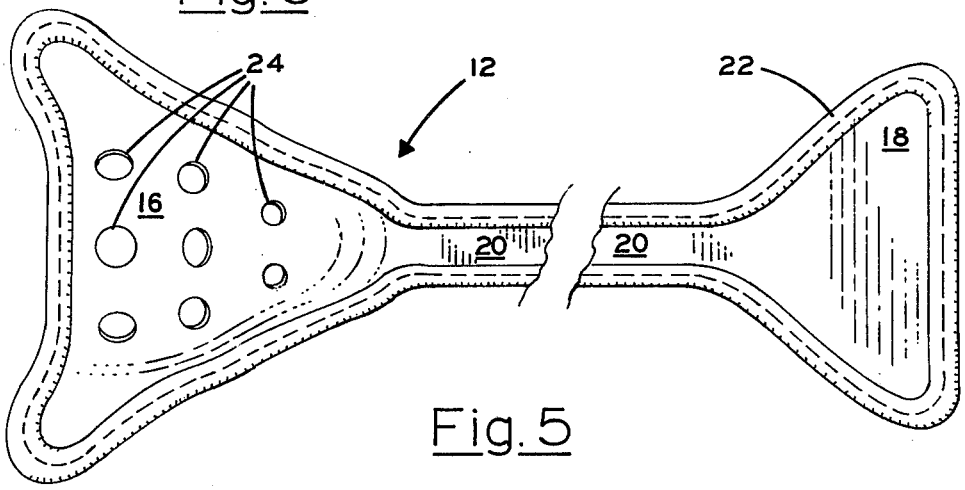
FIG. 5 is a fragmented plan view of the guard.

The guard 12, as best shown in FIG. 5, includes a protective cup 16, a base plate 18 and a protective bar 29 which extends between the cup and the plate. The cup 16 preferably is formed of a relatively hard synthetic resin, such as PVC, and is of a generally concave configuration suitable for accommodating a positioning thereof over the pelvic organs of a male athlete. It is important to note that the cup 16 also is of a generally triangular configuration having enlarged apexes of lobe-shaped configuration. Due to the configuration of the apexes of the cup, the surface area of the cup is increased so that the force of blows delivered to the cup can be distributed over larger surface areas for thus reducing the magnitude of the force of blows intercepted by the guard. Furthermore, the configuration of the cup 16 also has particular utility in maintaining the cup in operative protective position with respect to the pelvic region The plate 18, on the other hand, is of a substantially inverted pyramidal configuration and seats over the lumbar region of the wearer, slightly below the waistline thereof. Between the cup 16 and the plate 18 there is extended a protective bar which is integrally related with the cup and the plate. The length of the protective bar 20 may be varied, however, it is to be understood that the length thereof is such that the cup 16 and the plate 18 are appropriately seated within the garment without the bar being placed in engagement with the wearer, particularly in the region of the groin. As a practical matter, the protective bar 20 also is formed of a synthetic resin, such as PVC, characterized by a coefficient of stiffness which imparts to the bar rigidity sufficient to withstand impact. Moreover, the arcuate configuration of the bar serves to enhance the capability of withstanding the force of blows delivered to the periphery thereof. Finally, it is to be understood that the bar is bonded or otherwise united with both the cup 16 and the plate 18.

The guard 12 further includes a circumscribing band 22 of soft protective material, such as foamed plastisol, which serves to protect the wearer from the relatively sharp edges of the guard 12. This bank is held in place employing adhesives or the like. Additionally, the cut 16 is provided with a plurality of ventilating apertures 24 whereby air circulation in and about the cup is facilitated.

At the rear of the garment 14 there is provided a downwardly opening pocket 26, formed by stitching an additional layer, not designated, of material within the rear portions of the garment. This pocket serves to receive the plate 18 as it is inserted upwardly into a seated relationship therewith.

The cup 16, on the other hand, is supported in place, preferably at the outer surface of the garment 14 within a pocket 28 formed by a depending flap 30 adapted to be fastened to the outer surface of the garment. The flap 30 is stitched along a seam 32 which extends along the upper edge portion of the pocket 28, while snap fasteners 33 having opposite halves attached to the surface of the garment 14 and the flap 30 are provided for securing the depending portion of the flap 30.

It is important to note that the garment 14 includes a pair of tubular legs 34. The diameters of the legs 34 are such that the garment is restrained from upward migration due to a constricting engagement thereof with the legs of the wearer. Between the legs 34, the crotch of the garment is removed for thus providing a relief 36. The primary purpose of the relief 36 is to accommodate a full range of unrestrained leg motions.

Immediately above the crotch of the garment, spanning the relief 36, there is a shield 38. This shield preferably is of a fabric material and is positionable between the pelvic organs of the wearer and the protective bar 20. However, it is to be understood that the shield 38 includes a suitable opening, such as a slit or the like, which accommodates insertion of the guard 12 into the pocket 26.

OPERATION

It is believed that in view of the foregoing description, the operation of the device will readily be understood and it will be briefly reviewed at this point.

In order to prepare the device 10 for operation, the guard 12 initially is extended through the cloth shield 38 with the plate 18 being inserted into the downwardly opening pocket 26. The cup 16 is then placed within the pocket 28 formed by the flap 30 as the flap 30 is secured in place employing the snap fasteners 33. The garment 14 is then positioned on the wearer in substantially the same manner as a pair of trunks may be positioned for wearing. If desired, the wearer may also utilize an athletic supporter of conventional design.

Since the garment 14 is formed of elastomeric materials, it will be appreciated that a "skintight" fit of the garment is achieved as the device 10 is positioned on the wearer. However, torso and leg motions of the wearer are not impaired by the effects of this fit due to the fact that the relief 36 accommodates a full range of unrestrained motion.

Of course, the guard 12 readily can be disassociated from the garment 14 simply by unfastening the snap fasteners 33 and extracting the guard from the pockets 26 and 28.

When employed as a protective device for athletes engaged in the martial arts, it should be apparent that the cup 16 serves to protect substantially the entire pelvic region of the athlete as laterally projected blows impact against the cup with the force thereof being distributed over a wide surface area. Similarly, blows delivered toward the groin, along a line substantially paralleling the longitudinal axis of the torso, are intercepted by the protective bar 20 with the force thereof being dissipated at the plate 18 as well as the cup 16.

In view of the foregoing, it should readily be apparent that the device 10, which embodies the principles of the instant invention, provides a practical solution to the perplexing problem of protecting the pelvic organs of athletes, particularly those athletes engaged in the martial arts.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. A protective device particularly suited for use in protecting the pelvic organs of a wearer comprising:

A. a garment fabricated from elastomeric material and characterized by a tubular body portion configured to receive the body of a wearer, means for stabilizing the body portion of the garment on the body of a wearer including a pair of tubular leg portions attached to the body portion configured to receive the legs of the wearer in friction-fit engagement, means defining a first pocket in the body portion of the garment arranged to be disposed adjacent to the pelvic region of a wearer when the body of a wearer is received by the body portion of the garment, and means defining a second pocket in said body portion arranged to be disposed adjacent to the lumbar region of a wearer when said first pocket is disposed adjacent to said pelvic region; and B. a guard including a substantially rigid protective cup disposed in said first pocket adapted to be positioned in protective relation with the pelvic region of the wearer, a plate disposed in said second pocket adapted to be received over the lumbar region of the wearer, and a substantially rigid bar extended between the cup and the plate and connected thereto adapted to be received between the legs of a wearer in spaced protective relation with the pelvic organs of the wearer when the body of the wearer is received by the body portion of the garment.

2. The device of claim 1 wherein the means defining a first pocket includes a flap removably fastened to the outer surface of the garment and the means defining said second pocket includes a layer of material stitched to the inner surface of the garment.

3. The device of claim 1 further comprising means defining a relief in said garment between the leg portions thereof.

4. The device of claim 3 wherein said cup is formed of a hardened synthetic resin, and is of a concave, triangular configuration, at least two of the apexes thereof being of lobeshaped configurations.

5. The device of claim 4 further comprising an elongated, flexible shield disposed across the relief and having its opposite ends secured to said garment at the opposite end portions thereof.

* * * * *

UNITED STATES PATENT AND TRADEMARK OFFICE

CERTIFICATE OF CORRECTION

PATENT NO. : 4,014,044

DATED : March 29, 1977

INVENTOR(S) : David C. Figueroa and David R. Corneliuz

It is certified that error appears in the above-identified patent and that said Letters Patent are hereby corrected as shown below:

Column 1, Line 7, delete "particulary" and insert --- particularly ---.

Column 1, Line 28, delete "conbatants" and insert --- combatants ---.

Column 2, Line 22, delete "extending" and insert --- extended ---.

Column 2, Line 55, delete "29" and insert --- 20 ---.

Column 3, Line 2, after "region" insert --- of a wearer ---.

Column 3, Line 26, delete "bank" and insert --- band ---.

Column 6, Line 7, delete "lobeshaped" and insert --- lobe-shaped ---.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*